US010566684B2

(12) United States Patent
Wu et al.

(10) Patent No.: US 10,566,684 B2
(45) Date of Patent: Feb. 18, 2020

(54) AMPLIFIER INTEGRATED FEED ARRAY WITH MODULARIZED FEED ELEMENTS AND AMPLIFIERS

(71) Applicant: Space Systems/Loral, LLC, Palo Alto, CA (US)

(72) Inventors: Gordon Wu, Sunnyvale, CA (US); Matthew Stephen Parman, Mountain View, CA (US); Robert Jones, Union City, CA (US)

(73) Assignee: Space Systems/Loral, LLC, Palo Alto, CA (US)

( * ) Notice: Subject to any disclaimer, the term of this patent is extended or adjusted under 35 U.S.C. 154(b) by 134 days.

(21) Appl. No.: 15/699,909

(22) Filed: Sep. 8, 2017

(65) Prior Publication Data

US 2018/0131081 A1 May 10, 2018

Related U.S. Application Data

(60) Provisional application No. 62/419,887, filed on Nov. 9, 2016.

(51) Int. Cl.
*H01Q 21/00* (2006.01)
*H01Q 1/28* (2006.01)
(Continued)

(52) U.S. Cl.
CPC ..... *H01Q 1/288* (2013.01); *H01Q 1/12* (2013.01); *H01Q 1/22* (2013.01); *H01Q 15/14* (2013.01);
(Continued)

(58) Field of Classification Search
CPC .. H01Q 1/12; H01Q 1/22; H01Q 3/26; H01Q 15/14; H01Q 21/0025; H01Q 25/007; H01Q 1/288
See application file for complete search history.

(56) References Cited

U.S. PATENT DOCUMENTS 5,907,304 A * 5/1999 Wilson ..... H01Q 21/0087 343/700 MS
6,304,747 B1 10/2001 Loostrom et al.
(Continued)

OTHER PUBLICATIONS

Extended European Search Report dated Apr. 4, 2018 for EP Application No. 17200888.0.
(Continued)

*Primary Examiner* — Dieu Hien T Duong
(74) *Attorney, Agent, or Firm* — Weaver Austin Villeneuve & Sampson LLP

(57) ABSTRACT

A multi-beam antenna (MBA) system for a spacecraft, the MBA system including a reflector and a feed array of radiating feed elements configured as a phased array and illuminating the reflector. The feed array includes a plurality of interchangeable modules. Each of the plurality of interchangeable modules includes a distal mounting panel and a proximal mounting panel, and at least six feed array elements. Each feed array element is electrically coupled with a respective amplifier and mechanically coupled with an exterior surface of the distal mounting panel. The respective amplifiers are thermally coupled with the proximal mounting panel and are mechanically coupled to an interior surface of the distal mounting panel and an exterior surface of the proximal mounting panel. An interior surface of the proximal mounting panel of each interchangeable module is mechanically and thermally coupled with a back plate.

19 Claims, 8 Drawing Sheets

(51) Int. Cl.

| | |
|---|---|
| ***H01Q 1/12*** | (2006.01) |
| ***H01Q 1/22*** | (2006.01) |
| ***H01Q 15/14*** | (2006.01) |
| *H01Q 1/02* | (2006.01) |
| *H01Q 3/26* | (2006.01) |

(52) U.S. Cl.
CPC ..... *H01Q 21/0025* (2013.01); *H01Q 1/02* (2013.01); *H01Q 3/267* (2013.01)

(56) References Cited

U.S. PATENT DOCUMENTS

| | | | | |
|---|---|---|---|---|
| 6,469,671 | B1 * | 10/2002 | Pluymers ..... | G01S 7/032 343/700 MS |
| 9,379,438 | B1 | 6/2016 | Runyon et al. | |
| 2002/0080066 | A1 | 6/2002 | Dent | |
| 2005/0093744 | A1 | 5/2005 | Davis et al. | |
| 2005/0110681 | A1 | 5/2005 | Londre | |
| 2008/0150832 | A1 | 6/2008 | Ingram et al. | |
| 2009/0179791 | A1 | 7/2009 | Kalian et al. | |
| 2011/0109507 | A1 | 5/2011 | Warnick | |
| 2015/0295640 | A1 * | 10/2015 | Burr ..... | H04B 7/2041 342/354 |

OTHER PUBLICATIONS

Lier, E. et al., "A Modular and Lightweight Multibeam Active Phased Receiving Array for Satellite Applications: Design and Gro~nd Testing," Lockheed Martin Commercial Space Systems, 100 Campus Drive, Newtown, PA 18940 USA, IEEE Antennas and Propagation Magazine, vol. 51, No. 1, Feb. 2009, ISSN 1045-9243120091$25 C20091EEE, 11 pages.

* cited by examiner

AMPLIFIER INTEGRATED FEED ARRAY WITH MODULARIZED FEED ELEMENTS AND AMPLIFIERS

CROSS-REFERENCE TO RELATED APPLICATIONS

This disclosure claims priority to U.S. Provisional Patent Application No. 62/419,887, filed Nov. 9, 2016, entitled "AMPLIFIER INTEGRATED FEED ARRAY WITH MODULARIZED FEED ELEMENTS AND AMPLIFIERS", assigned to the assignee hereof, the disclosure of which in hereby incorporated by reference in its entirety into this patent Application for all purposes.

TECHNICAL FIELD

The present disclosure relates generally to satellite antennas, and particularly to an imaging array fed reflector for a high throughput satellite payload.

BACKGROUND

The assignee of the present invention manufactures and deploys spacecraft for, inter alia, communications and broadcast services. Market demands for such spacecraft have imposed increasingly stringent requirements on spacecraft payloads. For example, broadband service providers desire spacecraft with increased data rate capacity at higher EIRP through each of an increased number of user spot beans operable from geosynchronous orbit altitudes in communication with small (<1 meter aperture) user terminals.

A multi-beam antenna (MBA) system generates a set of user spot beams that define a coverage area which may extend, in aggregate, across a large region on the ground. MBA's providing wide-band communications services from a geosynchronous satellite conventionally provide contiguous coverage of a region with a triangular lattice of overlapping circular antenna beams. These beams are conventionally formed using clusters of radiating elements, also centered on a triangular lattice.

For high throughput satellite applications, some thousands of feed elements may be desired to illuminate a large aperture antenna reflector.

Improved techniques for implementing feed arrays with a large number of radiating elements are desirable.

SUMMARY

The systems, methods and devices of this disclosure each have several innovative aspects, no single one of which is solely responsible for the desirable attributes disclosed herein.

According to some implementations, a multi-beam antenna (MBA) system for a spacecraft includes a reflector and a feed array of radiating feed elements configured as a phased array and illuminating the reflector, operable at a frequency having a characteristic wavelength (λ). The feed array includes a plurality of interchangeable modules each of the plurality of interchangeable modules including a first distal mounting panel and a proximal mounting panel, and at least six feed array elements. Each feed array element is electrically coupled with a respective amplifier and mechanically coupled with an exterior surface of the first distal mounting panel. The respective amplifiers are thermally coupled with the proximal mounting panel and are coupled with an interior surface of the distal mounting panel and an exterior surface of the proximal mounting panel. An interior surface of the proximal mounting panel of each interchangeable module is mechanically and thermally coupled with a back plate.

In some examples, the back plate may be thermally coupled with one or more heat pipes.

In some examples, the feed array may include beam formers and the back plate includes a plurality of recessed portions, at least a portion of each beam former being disposed in a respective one of the plurality of recessed portions. In some examples, the portion of each beam former may be disposed between the back plate and the proximal mounting panel.

In some examples, the back plate may be configured to mechanically interface directly with two or more of the plurality of interchangeable modules. In some examples, the back plate may be a monolithic element configured to mechanically interface directly with each of the plurality of interchangeable modules.

In some examples, the back plate may be configured to mechanically interface directly with a single one of the plurality of interchangeable modules.

In some examples, each feed element, together with the respective amplifier, may be disposed in a closely packed triangular lattice such that separation between adjacent feed elements is not greater than 1.5λ.

In some examples, each amplifier, when operating may dissipate approximately 1-3 watts of waste heat.

In some examples, the MBA system may include a second distal mounting panel disposed between the first distal mounting panel and the respective amplifiers. The first distal mounting panel and the second distal mounting panel may be detachably coupled together such that the first distal mounting panel, together with the feed array of radiating feed elements, is removable from the second distal mounting panel.

According to some implementations, a method includes fabricating a plurality of interchangeable modules for a multi-beam antenna (MBA) system wherein the MBA system includes a feed array of radiating feed elements configured as a phased array, operable at a frequency having a characteristic wavelength (λ), the feed array including the plurality of interchangeable modules; each of the plurality of interchangeable modules includes a first distal mounting panel and a proximal mounting panel, and at least six feed array elements; each feed array element is electrically coupled with a respective amplifier and mechanically coupled with an exterior surface of the first distal mounting panel; and the respective amplifiers are thermally coupled with the proximal mounting panel and are coupled with an interior surface of the distal mounting panel and an exterior surface of the proximal mounting panel. The method includes performing functional testing of each interchangeable module and forming the feed array by integrating the interchangeable modules onto a back plate such that an interior surface of the proximal mounting panel of each interchangeable module is mechanically and thermally coupled with the back plate.

In some examples, the back plate may be thermally coupled with one or more heat pipes.

In some examples, integrating the interchangeable modules onto the back plate may include mechanically interfacing the back plate directly with two or more of the plurality of interchangeable modules. In some examples, integrating the interchangeable modules onto the back plate may include mechanically interfacing the back plate directly with each of the plurality of interchangeable modules.

In some examples, integrating the interchangeable modules onto the back plate may include mechanically interfacing the back plate directly with a single one of the plurality of interchangeable modules.

According to some implementations a spacecraft, includes a multi-beam antenna (MBA) system, a reflector, and a feed array of radiating feed elements configured as a phased array and illuminating the reflector, operable at a frequency having a characteristic wavelength (λ), the feed array including a plurality of interchangeable modules. Each of the plurality of interchangeable modules includes a distal mounting panel and a proximal mounting panel, and at least six feed array elements. Each feed array element is electrically coupled with a respective amplifier and mechanically coupled with an exterior surface of the distal mounting panel. The respective amplifiers are thermally coupled with the proximal mounting panel and are mechanically coupled to an interior surface of the distal mounting panel and an exterior surface of the proximal mounting panel. An interior surface of the proximal mounting panel of each interchangeable module is mechanically and thermally coupled with a back plate.

In some examples, the back plate may be thermally coupled with one or more heat pipes.

In some examples, the back plate may be configured to mechanically interface directly with two or more of the plurality of interchangeable modules. In some examples, the back plate may be a monolithic element configured to mechanically interface directly with each of the plurality of interchangeable modules.

Figure 1:
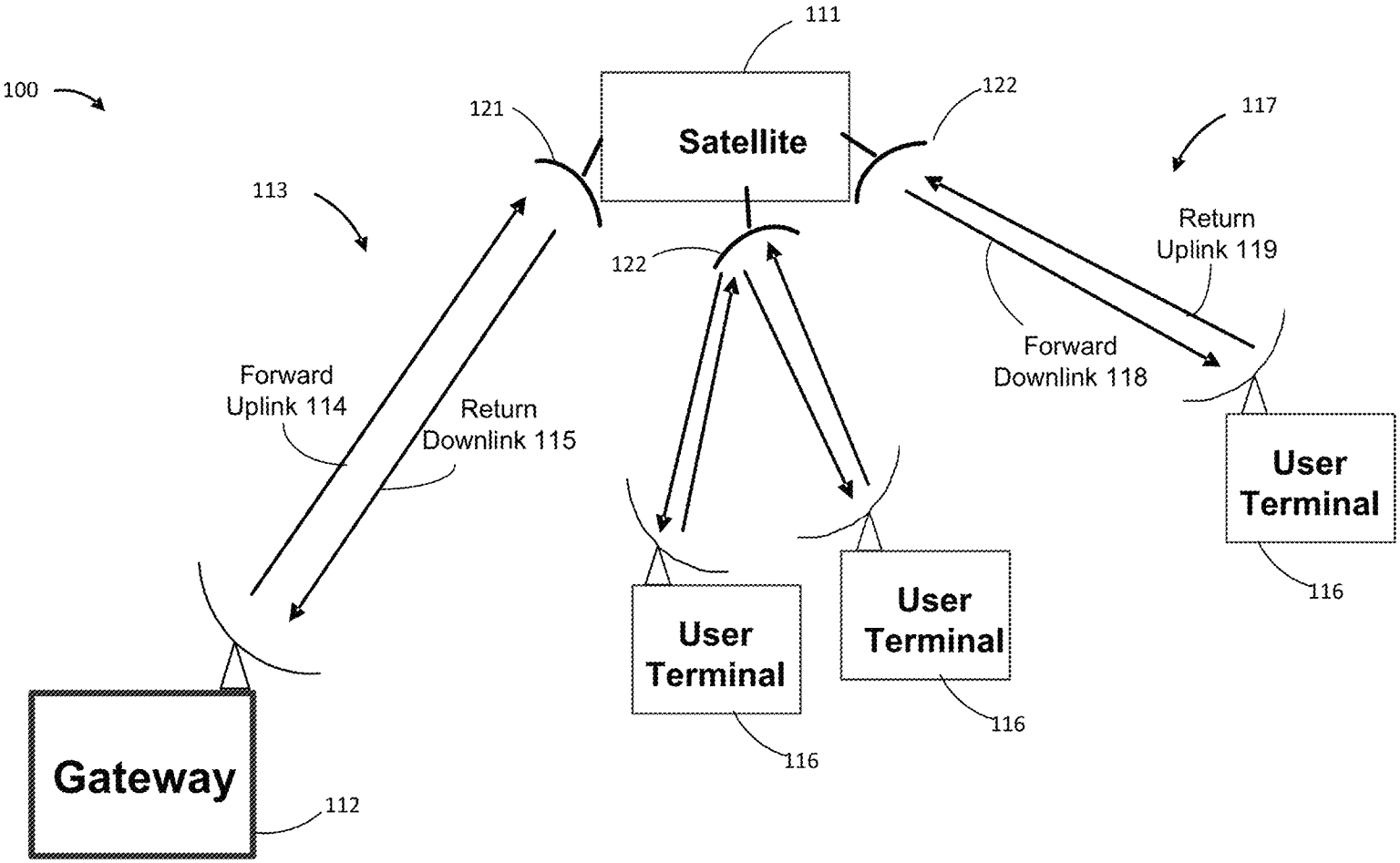
FIG. 1 illustrates a simplified diagram of a satellite communications network.

Throughout the drawings, the same reference numerals and characters, unless otherwise stated, are used to denote like features, elements, components, or portions of the illustrated embodiments. Moreover, while the subject invention will now be described in detail with reference to the drawings, the description is done in connection with the illustrative embodiments. It is intended that changes and modifications can be made to the described embodiments without departing from the true scope and spirit of the subject invention as defined by the appended claims.

DETAILED DESCRIPTION

Specific exemplary embodiments of the invention will now be described with reference to the accompanying drawings. This invention may, however, be embodied in many different forms, and should not be construed as limited to the embodiments set forth herein. Rather, these embodiments are provided so that this disclosure will be thorough and complete, and will fully convey the scope of the invention to those skilled in the art.

It will be understood that when a feature is referred to as being "connected" or "coupled" to another feature, it can be directly connected or coupled to the other feature, or intervening features may be present. Furthermore, "connected" or "coupled" as used herein may include wirelessly connected or coupled. It will be understood that although the terms "first" and "second" are used herein to describe various features, these features should not be limited by these terms. These terms are used only to distinguish one feature from another feature. Thus, for example, a first user terminal could be termed a second user terminal, and similarly, a second user terminal may be termed a first user terminal without departing from the teachings of the present invention. As used herein, the term "and/or" includes any and all combinations of one or more of the associated listed items. The symbol "/" is also used as a shorthand notation for "and/or".

The terms "spacecraft", "satellite" and "vehicle" may be used interchangeably herein, and generally refer to any orbiting satellite or spacecraft system.

Referring to FIG. 1, a simplified diagram of a satellite communications network 100 is illustrated. The network includes a satellite 111, which may be located, for example, at a geostationary orbital location or in low earth orbit. Satellite 111 may be communicatively coupled, via at least one feeder link antenna 121, to at least one gateway 112 and, via at least one user link antenna 122 to a plurality of user terminals 116. The at least one gateway 112 may be coupled to a network such as, for example, the Internet. Each gateway 112 and the satellite 111 communicate over a feeder link 113, which has both a forward uplink 114 and a return downlink 115. User terminals 116 and the satellite 111 communicate over a user link 117 that has both a forward downlink 118 and a return uplink 119. User link 117 and the feeder link may operate in respective assigned frequency bands, referred to herein as the "user link band" and the "feeder link band".

One or more of the feeder link antenna 121 and the user link antenna 122 may include a high efficiency multi-beam antenna (MBA) system of the type disclosed in U.S. Pat. No. 9,153,877 assigned to the assignee of the present invention, the disclosure of which is hereby incorporated into the present application in its entirety. The antenna reflector may be substantially oversized with respect to a reflector conventionally sized to produce a circular beam that is 4-4.5 dB down at the edge of coverage.

Figure 2:
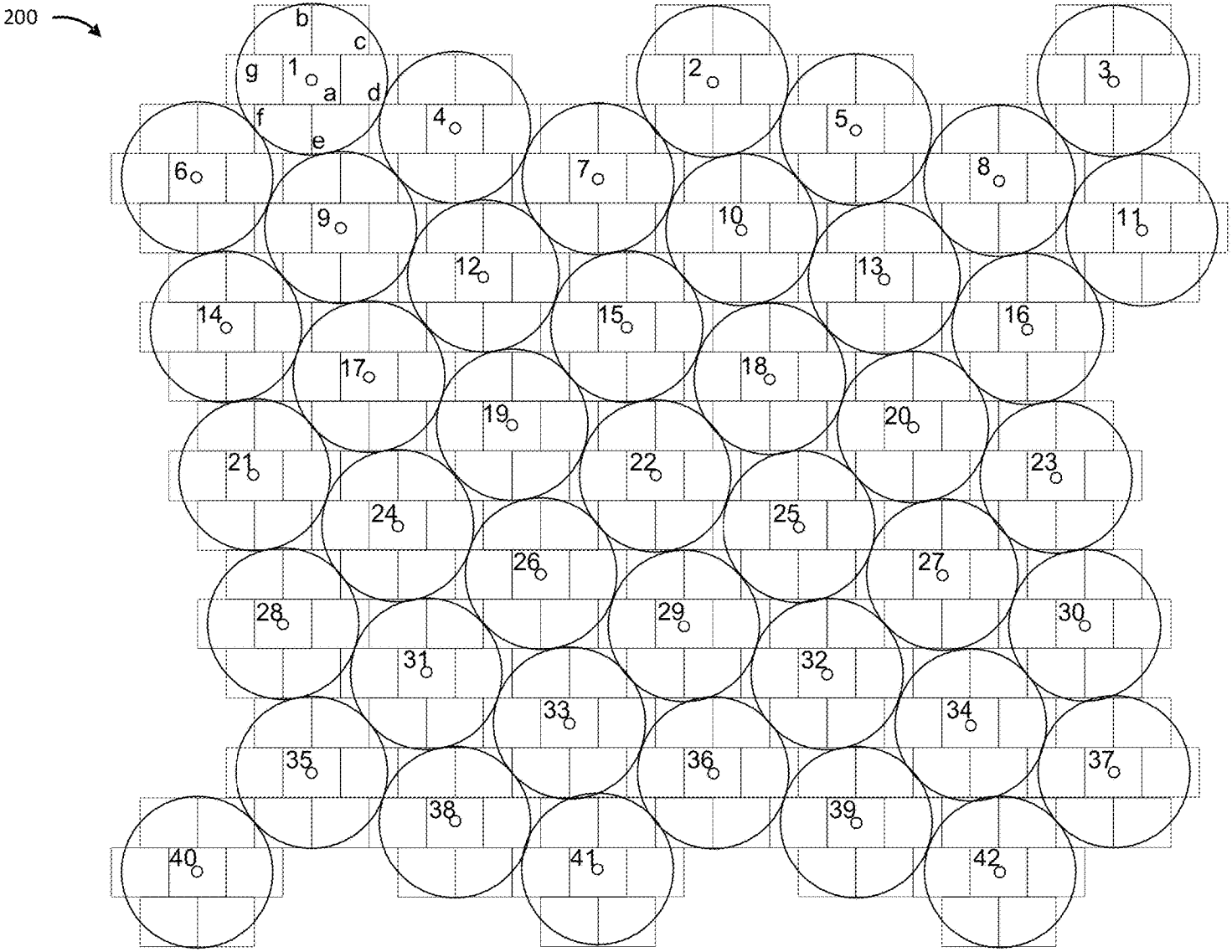
FIG. 2 illustrates an example of an active phased array.

In some implementations, each of a large number of beams is formed by a respective dedicated cluster of elements with no element sharing between beams, as described in more detail in U.S. patent application Ser. No. 15/438,620, entitled "IMAGING ARRAY FED REFLECTOR", assigned to the assignee of the present disclosure, the disclosure of which is hereby incorporated into the present application in its entirety. FIG. 2 illustrates an example of an active phased array. In the illustrated implementation, an active phased array 200 is configured to provide forty-two beams, each beam formed by a cluster of seven dedicated radiating elements. For example, beam number 1 is illustrated to be formed by radiating elements located at positions a, b, c, d, e, f and g. It may be observed that each radiating element is associated with a single respective beam. In an implementation, each radiating element includes a respective amplifier module disposed proximate to the radiating element. The beams are arranged in a close packed triangular lattice; likewise, the radiating elements are arranged in a close packed triangular lattice.

To facilitate the triangular lattice arrangement, each radiating element and a respective amplifier and related electronics may be arranged so as to be contained within a rectangular footprint area having an aspect ratio of short wall to long wall of $$\frac{\sqrt{3}}{2}:1.$$

Alternatively, each radiating element and a respective amplifier and related electronics may be arranged so as to be contained within a hexagonal footprint area. In either case, the footprint area is, advantageously, $$\frac{\sqrt{3}}{2}$$

times the spacing between adjacent elements ("element spacing") squared, in order to maximize packing efficiency. The element spacing may, advantageously, be small, for example less than 3λ. In an implementation, the element spacing is 1.1λ.

Figure 3:
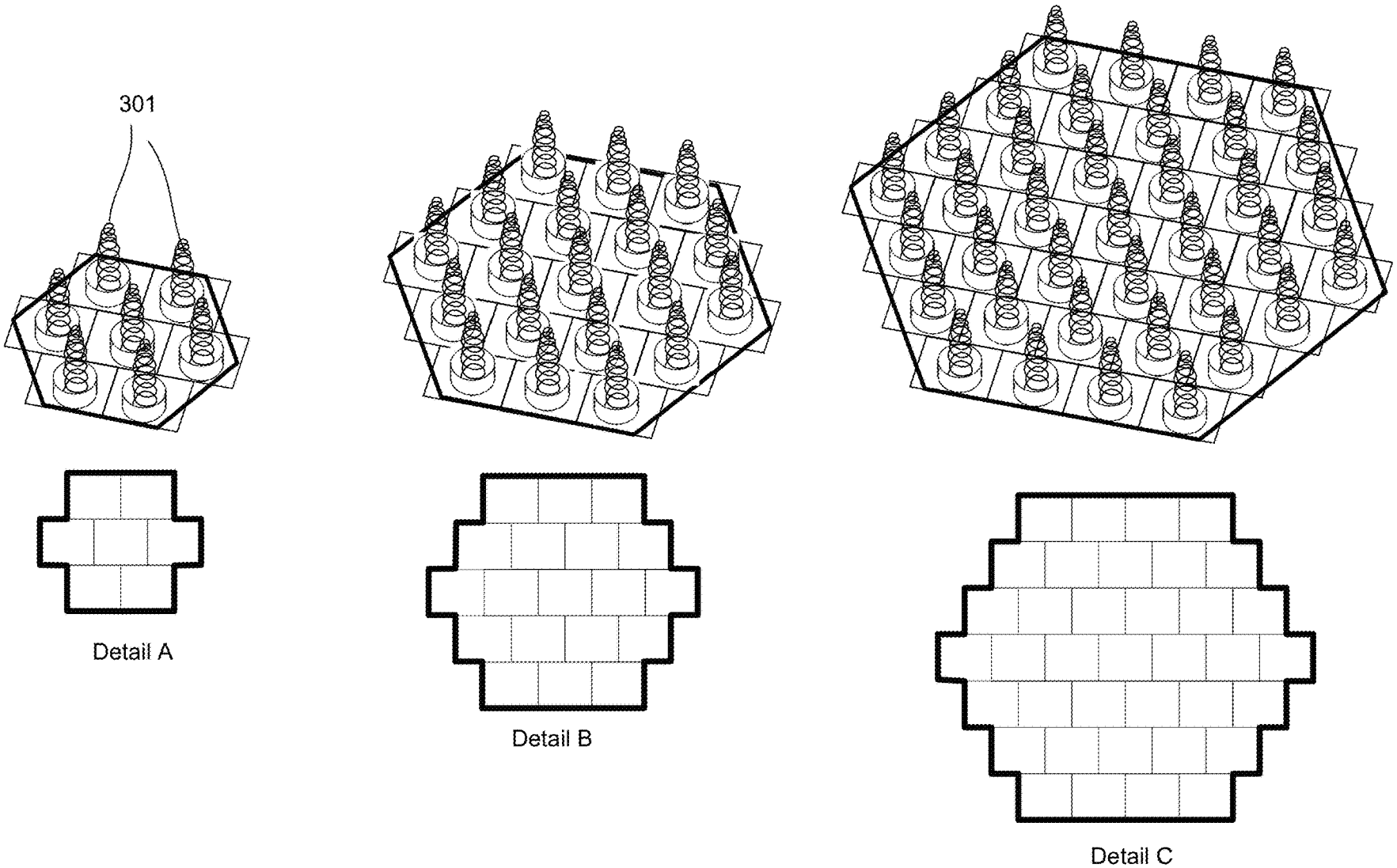
FIG. 3 illustrates examples of radiating feed element arrangements.

In the arrangement illustrated in FIG. 2, each beam is associated with seven radiating feed elements coupled with a single beam former (not illustrated). FIG. 3 illustrates a comparison of an arrangement for a beam, the beam being associated with seven radiating feed elements (Detail A) with an arrangement for a beam being associated with nineteen radiating feed elements (Detail B) coupled with a single beam former (not illustrated) and with an arrangement for a beams associated with thirty-seven helical radiating feed elements (Detail C) coupled with a single beam former (not illustrated). Examples of radiating feed elements suitable for operation with the disclosed techniques may include end fire elements and be configured as a cupped helix, a Yagi or crossed Yagi antenna element, a log-periodic antenna element, or a stacked patch antenna element.

In an implementation, each radiating feed element may be associated with a gallium nitride power amplifier. The power amplifiers may be produced by automated pick and place manufacturing. In an implementation, the amplifier may be a variant of the known Doherty configuration and may provide a high efficiency over an output back off range for linearity required for bandwidth efficient modulation and coding waveforms.

Each power amplifier may be coupled with a waveguide or coaxial cable. For example, where the feed array is associated with an uplink, the power amplifier may be a low noise amplifier (LNA) having an output coupled with, advantageously, a coaxial cable. As a further example, where the feed array is associated with a downlink, the power amplifier may be a high power amplifier (HPA) having an input coupled with, advantageously, a coaxial cable. In an implementation, each power amplifier is fed by a coaxial cable (rather than a waveguide) and configured such that an end-fire helical antenna feed element plugs directly into the power amplifier. When operating, each power amplifier may dissipate approximately 1-3 watts of power waste heat.

Figure 4:
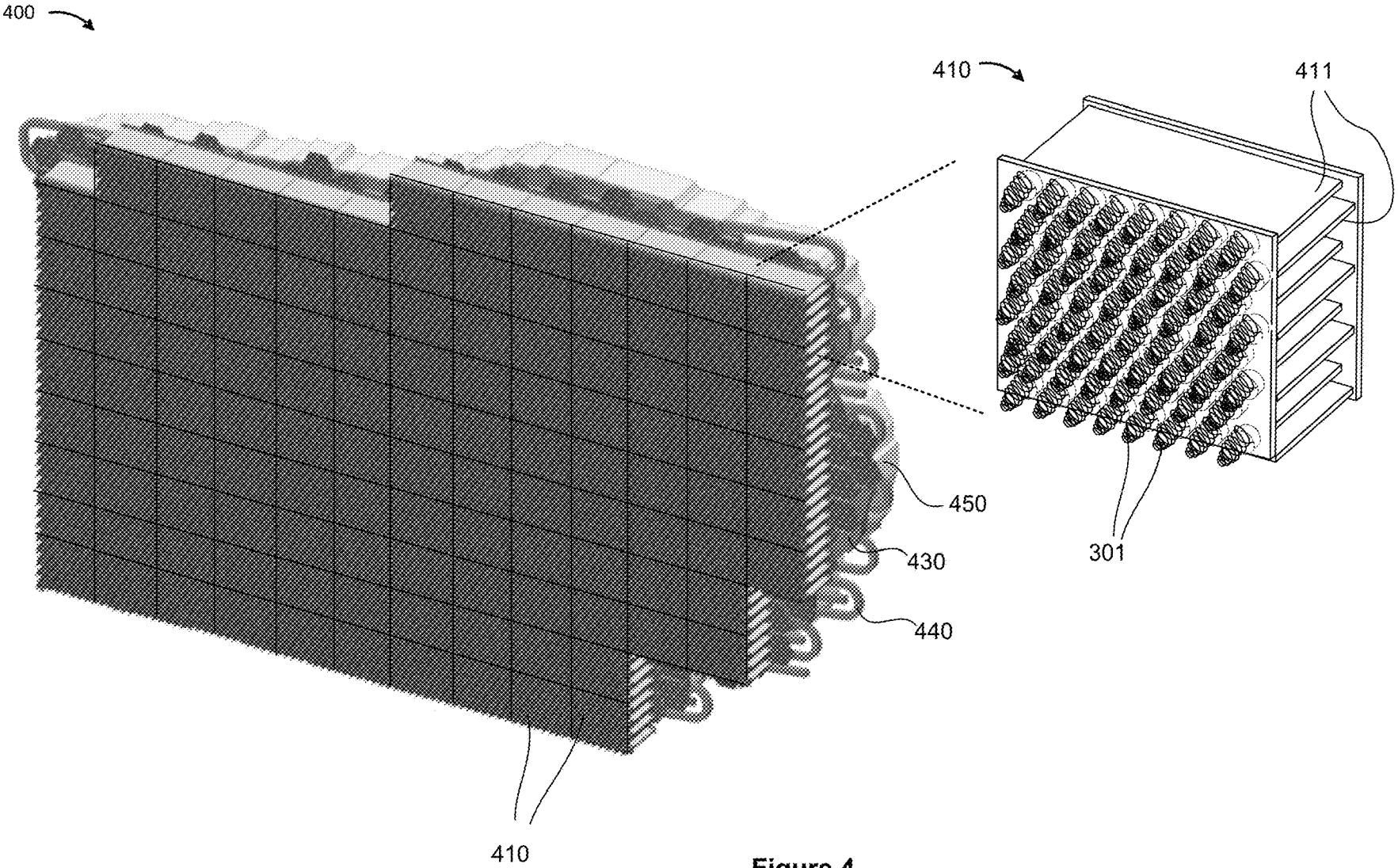
FIG. 4 illustrates an example of a feed array of radiating feed elements configured as a phased array, according to an implementation.

FIG. 4 illustrates an example of a feed array of radiating feed elements configured as a phased array, according to an implementation. In the illustrated implementation, an active phased array 400 includes over 7000 radiating elements. In accordance with the presently disclosed techniques, the active phased array 400 is configured as an arrangement of interchangeable modules 410, each module 410 including a number of feed array elements, and closely coupled respective amplifiers. In the illustrated implementation, the active phased array 400 includes 115 interchangeable modules 410 (disposed in a row/column arrangement that includes 10 rows and 13 columns, the 13 columns including one column that includes six modules 410, three columns that each include eight modules 410, five columns that each include nine modules 410, and four columns that each include ten modules 410). Each interchangeable module 410 includes 64 radiating elements 301 and 64 respective amplifiers. The amplifiers may be gallium nitride (GaN) solid-state amplifiers, for example. In the illustrated implementation, each module 410 includes eight submodules 411, each submodule 411 including eight GaN amplifiers (not illustrated). In the illustrated example implementation, each module 410 has an approximately square footprint of approximately 6"×6". Although, in the illustrated implementation, module 410 includes 64 radiating elements and 64 amplifiers, it is contemplated that the module 410 may include as few as six radiating elements (for example, two submodules, each including three amplifiers) and as many as four hundred radiating elements (for example, 20 submodules, each including 20 amplifiers).

In the illustrated implementation, the active phased array 400 includes a back plate 430 with which the interchangeable modules 410 may be mechanically and thermally coupled with a plurality of heat pipes 440. The back plate 430 may be thermally coupled with the heat pipes 440. The heat pipes 440 may be embedded in or otherwise coupled with an equipment panel 450. In some implementations, the equipment panel 450 may be a laminated, honeycomb core, panel with aluminum or composite face skins, for example. Although, in the illustrated implementation, the back plate 430 is a monolithic element configured to mechanically interface directly with each of the plurality of interchangeable modules 410, other arrangements are within the contemplation of the present disclosure. For example, in some implementations, the back plate may be configured to mechanically interface directly with two or more, but not all of the plurality of interchangeable modules 410. In other implementations, each interchangeable module may include an individual, dedicated back plate, and each back plate may be configured to mechanically interface directly with a single one of the plurality of interchangeable modules.

Figure 5:
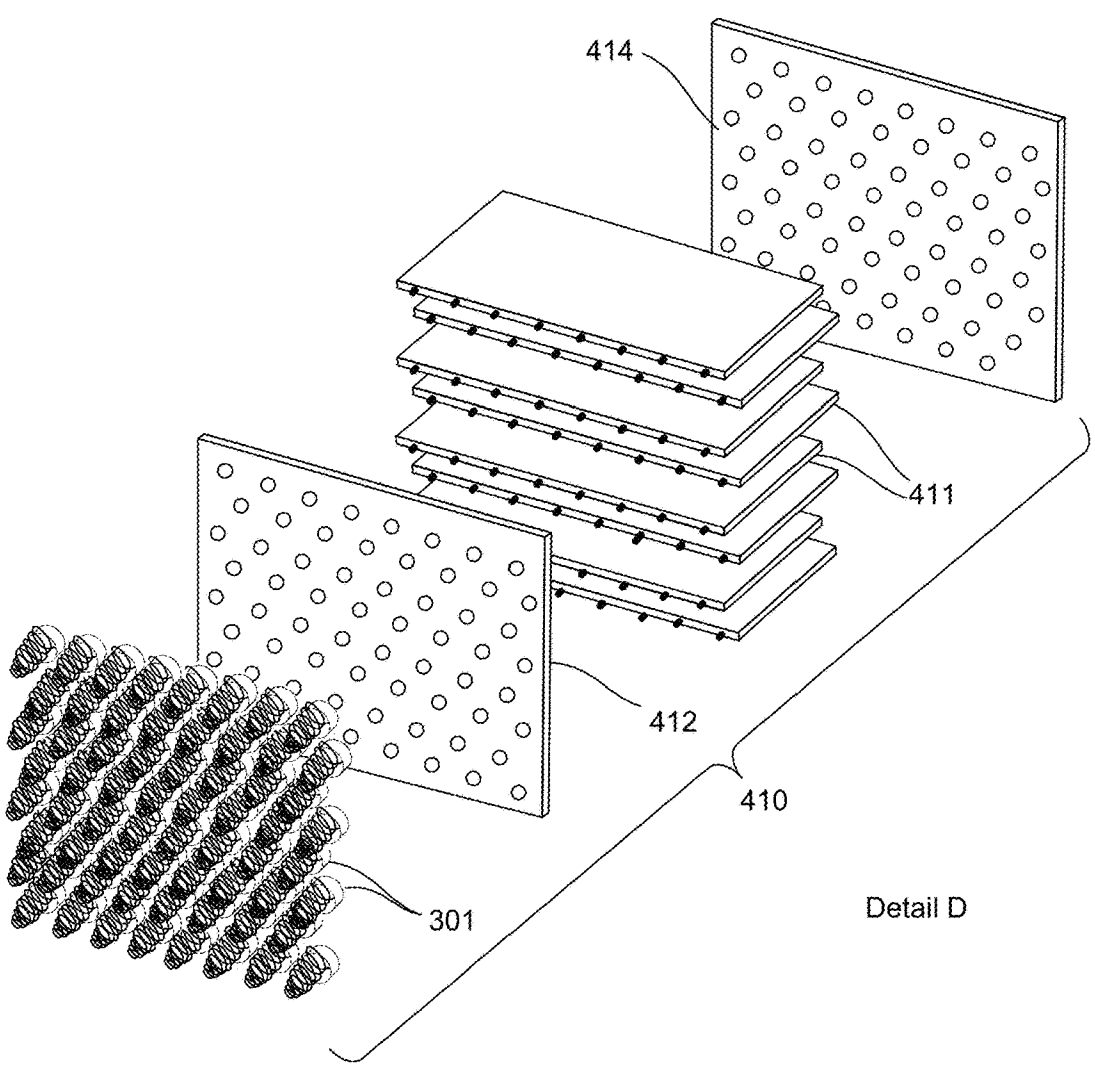
FIG. 5 illustrates an interchangeable module, according to an implementation.
Figure 5:
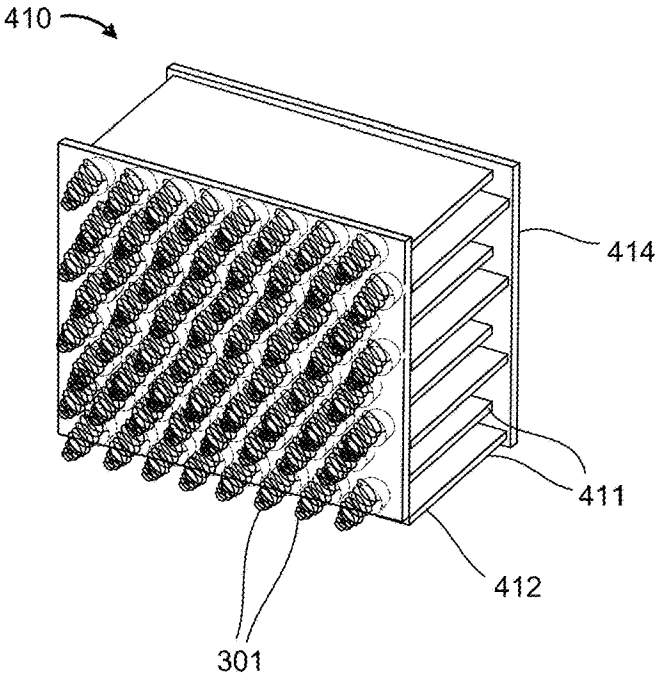

Referring now to FIG. 5, Detail D, an exploded view of the interchangeable module 410 is depicted. The interchangeable module 410 includes 64 helical radiating elements 301, and eight submodules 411. The submodules 411 may be mechanically coupled with a proximal (interior) surface of a distal mounting panel 412 and with a distal (exterior) surface of a proximal mounting panel 414. Each submodule 411 may include eight GaN amplifiers (not illustrated). The submodules 411, advantageously, may be thermally coupled with the proximal mounting panel 414 such that waste heat from the amplifiers, which may be on the order of 1-3 watts per amplifier, is thermally conducted to the proximal mounting panel 414. The proximal mounting panel 414 may function as a heat spreader, so as to better distribute heat conducted from the amplifiers. In some implementations, the distal mounting panel 412 may be a laminated, honeycomb core, panel with aluminum or composite face skins, for example.

Figure 6:
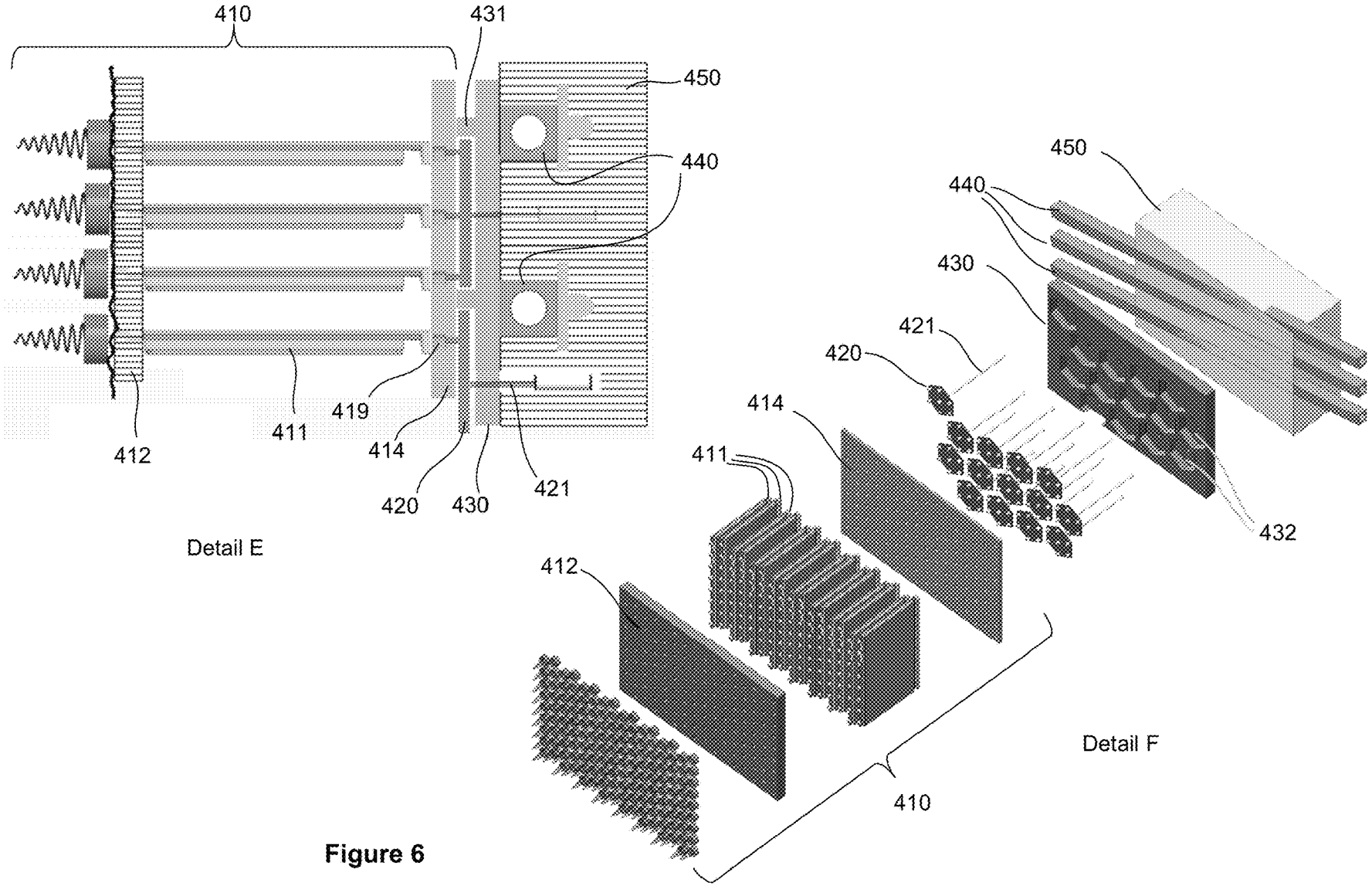
FIG. 6 illustrates a cross-sectional side view and an exploded view of a portion of the active phased array including a portion of one interchangeable module, according to an implementation.

FIG. 6 illustrates a cross-sectional side view (Detail E) and an exploded view (Detail F) of a portion of the active phased array 400 including a portion of one interchangeable module 410. It may be observed that the back plate 430 is disposed between the proximal mounting panel 414 and heat pipes 440. In the illustrated implementation, the heat pipes 440 are embedded in the equipment panel 450. It should be noted that FIG. 6 illustrates only a portion of the back plate 430, the honeycomb panel 450 and the heat pipes 440. As explained above in connection with FIG. 4, the back plate 430, honeycomb panel 450 and heat pipes 440 may be sized so as to accommodate a substantial number of interchangeable modules 410.

The back plate 430 may include a protruding portion 431 that is thermally coupled with a proximal surface of the proximal mounting panel 414. The back plate 430 may also include recessed portions 432 within which beam formers 420 may be disposed. In the illustrated implementation, each beam former 420 is associated with 7 feed elements, consistent with Detail A of FIG. 3. In other implementations, some or all of the beam formers 420 may be associated with 19 feed elements (Detail B), or 37 feed elements (Detail C), for example. Each beam former 420 may be electrically coupled with a plurality of amplifier submodules 411 by way of connectors 419 and with spacecraft electronics by way of connectors 421. It will be appreciated that electrical pass-throughs (not illustrated) may be disposed in the proximal mounting panel 414 and the back plate 430 to accommodate, respectively, the connectors 419 and the connectors 421.

Figure 7:
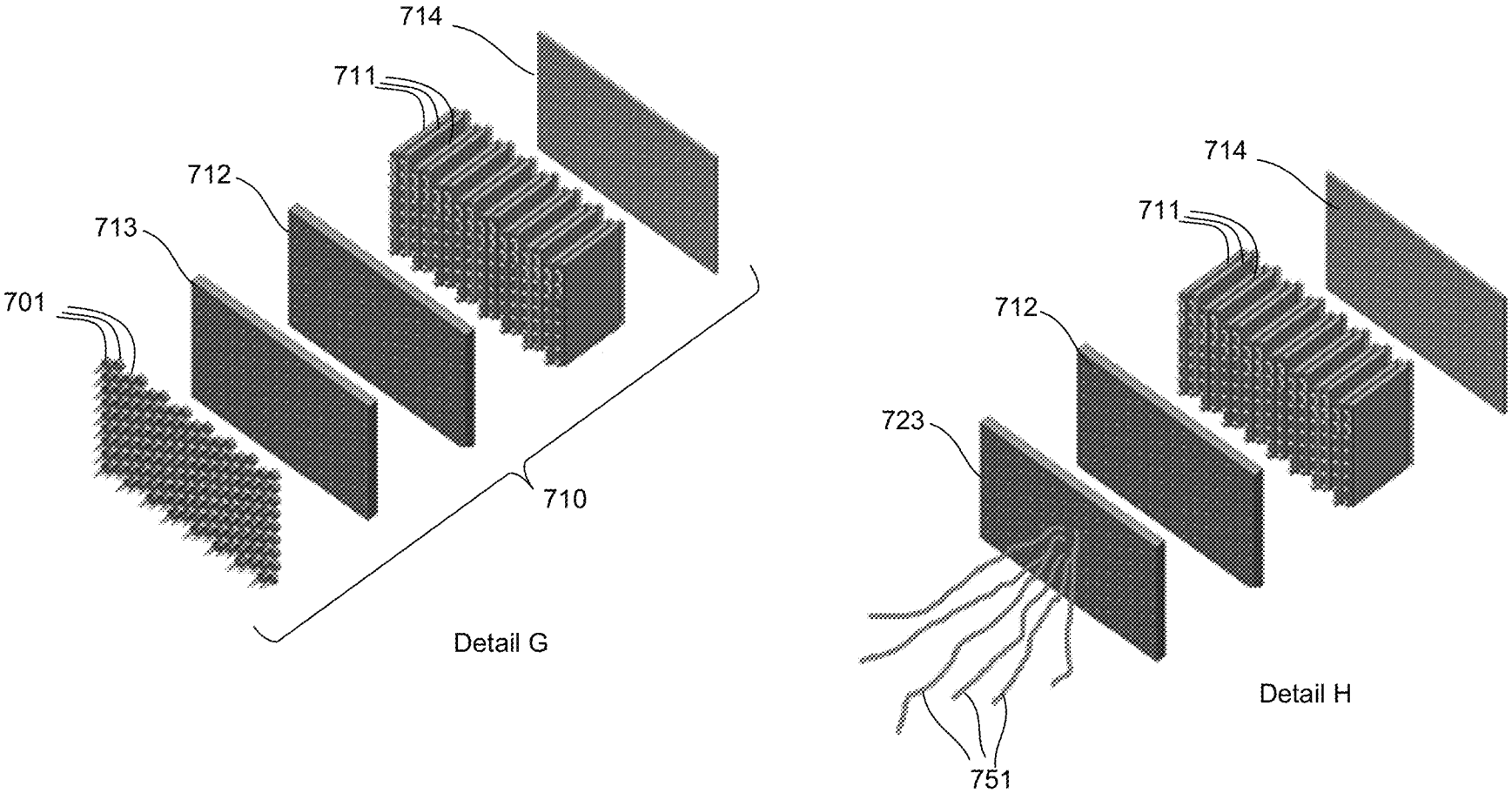
FIG. 7 illustrates an interchangeable module, according to another implementation.

FIG. 7 illustrates an interchangeable module, according to another implementation. Referring now to Detail G, an exploded view of an interchangeable module 710 is depicted. The interchangeable module 710 includes helical radiating elements 701 mechanically coupled with a first distal mounting panel 713, and submodules 711. The submodules 711 may be mechanically coupled with a proximal (interior) surface of a second distal mounting panel 712 and with a distal (exterior) surface of a proximal mounting panel 714. The submodules 711, advantageously, may be thermally coupled with the proximal mounting panel 714 such that waste heat from the amplifiers is thermally conducted to the proximal mounting panel 714. The proximal mounting panel 714 may function as a heat spreader, so as to better distribute heat conducted from the amplifiers. In some implementations, the second distal mounting panel 712 may be a laminated, honeycomb core, panel with aluminum or composite face skins, for example. In the illustrated implementation, the first distal mounting panel 713 is disposed between radiating elements 701 and the second distal mounting panel 712. Advantageously, the first distal mounting panel 713 may be detachably coupled with the second distal mounting panel 712 such that the first distal mounting panel 713, together with the radiating elements 701, may be readily removed to facilitate testing.

Referring now to Detail H, when the first distal mounting panel 713, together with the radiating elements 701, is detached from the second distal mounting panel 712, testing of other components (e.g., submodules 711 and beam formers (not illustrated)) may be carried out using a test fixture 723 coupled to test cables 751. As a result, at least some functional and diagnostic testing may be performed without the need to accommodate radiating feeds and associated test chamber cost and complexity.

Figure 8:
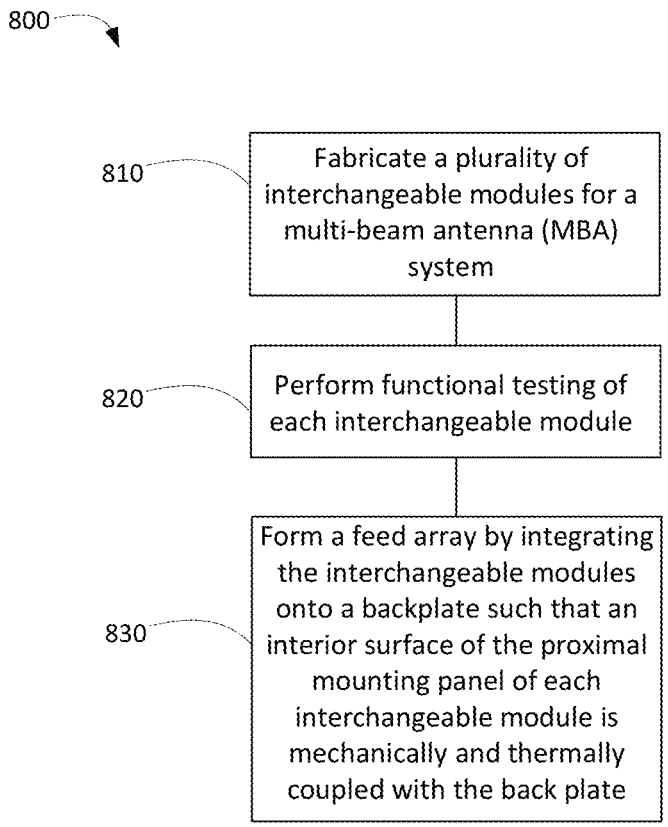
FIG. 8 illustrates a process flow diagram for manufacturing a multi-beam antenna (MBA) system, according to an implementation.

FIG. 8 illustrates a process flow diagram for manufacturing a multi-beam antenna (MBA) system, according to an implementation. As described hereinabove, the MBA may include a feed array of radiating feed elements configured as a phased array, operable at a frequency having a characteristic wavelength (λ), the feed array including a plurality of interchangeable modules. Each of the plurality of interchangeable modules may include a distal mounting panel and a proximal mounting panel, and at least six feed array elements. Each feed array element may be electrically coupled with a respective amplifier and mechanically coupled with an exterior surface of the distal mounting panel. The respective amplifiers may be thermally coupled with the proximal mounting panel and may be mechanically coupled to an interior surface of the distal mounting panel and an exterior surface of the proximal mounting pane. The method 800 may start, at block 810, with fabricating a plurality of interchangeable modules. At block 820, functional testing of each interchangeable module may be performed. Advantageously, the functional testing may be performed in parallel, such that a problem with any individual interchangeable module need not affect the testing schedule or sequence of other interchangeable modules.

At block 830, the method may conclude with forming the feed array by integrating the interchangeable modules onto a back plate such that an interior surface of the proximal mounting panel of each interchangeable module is mechanically and thermally coupled with the back plate.

Thus, an amplifier integrated feed array with modularized feed elements and amplifiers has been described. The foregoing merely illustrates principles of the invention. It will thus be appreciated that those skilled in the art will be able to devise numerous systems and methods which, although not explicitly shown or described herein, embody said principles of the invention and are thus within the spirit and scope of the invention as defined by the following claims.

What is claimed is:

1. A multi-beam antenna (MBA) system for a spacecraft, the MBA system including:

a reflector; and a feed array of radiating feed elements configured as a phased array and illuminating the reflector, operable at a frequency having a characteristic wavelength (A), the feed array including a plurality of interchangeable modules, wherein:

each of the plurality of interchangeable modules includes a first distal mounting panel and a proximal mounting panel, and at least six feed array elements;

each feed array element is electrically coupled with a respective amplifier and mechanically coupled with an exterior surface of the first distal mounting panel;

the respective amplifiers are disposed between the proximal mounting panel and the distal mounting panel, coupled with an interior surface of the first distal mounting panel and an exterior surface of the proximal mounting panel and thermally coupled with the proximal mounting panel; and an interior surface of the proximal mounting panel of each interchangeable module is mechanically and thermally coupled with a back plate;

wherein the feed array includes beam formers and the back plate includes a plurality of recessed portions, at least a portion of each beam former being disposed in a respective one of the plurality of recessed portions.

2. The MBA system of claim 1, wherein the back plate is thermally coupled with one or more heat pipes.

3. The MBA system of claim 1, wherein the portion of each beam former is disposed between the back plate and the proximal mounting panel.

4. The MBA system of claim 1, wherein the back plate is configured to mechanically interface directly with two or more of the plurality of interchangeable modules.

5. The MBA system of claim 4, wherein the back plate is a monolithic element configured to mechanically interface directly with each of the plurality of interchangeable modules.

6. The MBA system of claim 1, wherein the back plate is configured to mechanically interface directly with a single one of the plurality of interchangeable modules.

7. The MBA system of claim 1, wherein each feed element, together with the respective amplifier, is disposed in a closely packed triangular lattice such that separation between adjacent feed elements is not greater than 1.5λ.

8. The MBA system of claim 1, wherein each amplifier, when operating dissipates approximately 1-3 watts of waste heat.

9. The MBA system of claim 1, further comprising a second distal mounting panel disposed between the first distal mounting panel and the respective amplifiers.

10. The MBA system of claim 9, wherein, the first distal mounting panel and the second distal mounting panel are detachably coupled together such that the first distal mounting panel, together with the feed array of radiating feed elements, is removable from the second distal mounting panel.

11. A method comprising:

fabricating a plurality of interchangeable modules for a multi-beam antenna (MBA) system wherein:

the MBA system includes a feed array of radiating feed elements configured as a phased array, operable at a frequency having a characteristic wavelength (A), the feed array including the plurality of interchangeable modules;

each of the plurality of interchangeable modules includes a distal mounting panel and a proximal mounting panel, and at least six feed array elements;

each feed array element is electrically coupled with a respective amplifier and mechanically coupled with an exterior surface of the distal mounting panel; and the respective amplifiers are disposed between the proximal mounting panel and the distal mounting panel, coupled with an interior surface of the distal mounting panel and an exterior surface of the proximal mounting panel and thermally coupled with the proximal mounting panel;

performing functional testing of each interchangeable module; and forming the feed array by integrating the interchangeable modules onto a back plate such that an interior surface of the proximal mounting panel of each interchangeable module is mechanically and thermally coupled with the back plate;

wherein the feed array includes beam formers and the back plate includes a plurality of recessed portions, at least a portion of each beam former being disposed in a respective one of the plurality of recessed portions.

12. The method of claim 11, wherein the back plate is thermally coupled with one or more heat pipes.

13. The method of claim 11, wherein integrating the interchangeable modules onto the back plate includes mechanically interfacing the back plate directly with two or more of the plurality of interchangeable modules.

14. The method of claim 13, wherein integrating the interchangeable modules onto the back plate includes mechanically interfacing the back plate directly with each of the plurality of interchangeable modules.

15. The method of claim 11, wherein integrating the interchangeable modules onto the back plate includes mechanically interfacing the back plate directly with a single one of the plurality of interchangeable modules.

16. A spacecraft, comprising:

multi-beam antenna (MBA) system;

a reflector; and a feed array of radiating feed elements configured as a phased array and illuminating the reflector, operable at a frequency having a characteristic wavelength (A), the feed array including a plurality of interchangeable modules, wherein:

each of the plurality of interchangeable modules includes a distal mounting panel and a proximal mounting panel, and at least six feed array elements;

each feed array element is electrically coupled with a respective amplifier and mechanically coupled with an exterior surface of the distal mounting panel;

the respective amplifiers are disposed between the proximal mounting panel and the distal mounting panel, mechanically coupled to an interior surface of the distal mounting panel and an exterior surface of the proximal mounting panel thermally coupled with the proximal mounting panel; and an interior surface of the proximal mounting panel of each interchangeable module is mechanically and thermally coupled with a back plate;

wherein the feed array includes beam formers and the back plate includes a plurality of recessed portions, at least a portion of each beam former being disposed in a respective one of the plurality of recessed portions.

17. The spacecraft of claim 16, wherein the back plate is thermally coupled with one or more heat pipes.

18. The spacecraft of claim 16, wherein the back plate is configured to mechanically interface directly with two or more of the plurality of interchangeable modules.

19. The spacecraft of claim 18, wherein the back plate is a monolithic element configured to mechanically interface directly with each of the plurality of interchangeable modules.

* * * * *